US005687521A

United States Patent [19]

Carlson et al.

[11] Patent Number: 5,687,521

[45] Date of Patent: Nov. 18, 1997

[54] TRANSLUCENT BLOCK ASSEMBLIES

[75] Inventors: Marlon Carlson; Julian Carlson, both of Beaumont, Calif.

[73] Assignees: Carlson Ventures, Inc.; Fairmount Ventures, both of Beaumont, Calif.

[21] Appl. No.: 659,470

[22] Filed: Jun. 4, 1996

Related U.S. Application Data

[63] Continuation of Ser. No. 489,531, Jun. 12, 1995, abandoned, which is a continuation-in-part of Ser. No. 353,407, Dec. 9, 1994, abandoned.

[51] Int. Cl.[6] ..... E04C 1/42

[52] U.S. Cl. ..... 52/308; 52/204.53; 52/204.7; 52/306; 52/775

[58] Field of Search ..... 49/440; 52/204.51, 52/204.53, 204.58, 204.7, 204.71, 207, 213, 215, 306, 307, 308, 770, 775, 780, DIG. 17

[56] References Cited

U.S. PATENT DOCUMENTS

| | | | |
|---|---|---|---|
| 1,873,350 | 8/1932 | Smith | 52/770 |
| 1,985,992 | 1/1935 | Hayman . | |
| 2,140,998 | 12/1938 | Hohl . | |
| 2,228,363 | 1/1941 | Pinney | 52/308 X |
| 2,244,739 | 6/1941 | Sylvan | 49/440 X |
| 2,589,879 | 3/1952 | Sheppard | 52/780 X |
| 2,837,784 | 6/1958 | Jannette | 52/204.7 X |
| 3,234,699 | 2/1966 | Smith | 52/308 |
| 3,393,487 | 7/1968 | Nolan | 52/204.51 |
| 3,420,026 | 1/1969 | Nolan | 52/204.51 |
| 4,648,226 | 3/1987 | Manon | 52/780 X |
| 4,891,925 | 1/1990 | Carlson et al. . | |
| 4,993,188 | 2/1991 | Erickson et al. | 52/207 X |
| 5,010,704 | 4/1991 | Thompson . | |
| 5,031,372 | 7/1991 | McCluer . | |
| 5,042,210 | 8/1991 | Taylor | 52/307 |
| 5,079,886 | 1/1992 | Downs | 52/308 X |
| 5,367,846 | 11/1994 | von Roenn, Jr. | 52/308 |
| 5,491,940 | 2/1996 | Bruchu | 52/213 |

OTHER PUBLICATIONS

"More Light, More Beauty, More Comfort in Your Home with PC Glass Blocks", A.I.A. File #10–F, Pittsburgh Corning, 1948.

*Primary Examiner*—Carl D. Friedman
*Assistant Examiner*—Kevin D. Wilkens
*Attorney, Agent, or Firm*—Townsend and Townsend and Crew LLP

[57] ABSTRACT

A translucent block assembly, for use in a decorative wall, window or the like in a building, has a connector extrusion for connecting juxtaposed translucent blocks in an opening of a frame having a recess extending around the opening. The connector extrusion has an alignment projection fitting snugly into gaps in the peripheries of the blocks for aligning the blocks and abutment faces for abutment with the blocks, and also has outwardly facing side faces engaging snugly in the recess.

10 Claims, 5 Drawing Sheets

TRANSLUCENT BLOCK ASSEMBLIES

CROSS-REFERENCE TO RELATED APPLICATION

This is a Continuation of application Ser. No. 08/489,531, filed Jun. 12, 1995, now abandoned, which is a continuation-in-part of application Ser. No. 08/353,407, filed Sep. 12, 1994, now abandoned.

BACKGROUND OF THE INVENTION

1. Field of the Invention

The present invention relates to translucent block assemblies for use in, for example, decorative wall constructions and windows in buildings.

2. Description of the Related Art

In our prior U.S. Pat. No. 4,891,925, issued Jan. 9, 1990, the disclosure of which is incorporated herein by reference, there is described a translucent construction block, made of plastic material, which can be connected together with a plurality of similar blocks by means of connecting members which have T-shaped ends engaged in T-shaped recesses formed at the corners of the blocks. The recesses are formed in enlarged portions at each corner of the block, the enlarged portions being spaced apart from one another in pairs for receiving therebetween an alignment strip attached to, for example, an existing wall by an adhesive backing. In this way, the block is positively located on the alignment strip, and the blocks can be quickly and easily positioned, using the alignment strip as a starting guide. In practice, the translucent blocks disclosed in the above-identified prior patent are frequently sold in an assembled condition, in a frame, and the blocks are manufactured in various widths, measured transversely of the major faces of the blocks, depending on the intended final use of the assemblies.

There are also available at the present time window frames which are formed with recesses of predetermined width for receiving windows of standard width. However, these standard window widths are substantially smaller than the widths of the translucent blocks manufactured in accordance with the teachings of the above-identified prior patent.

BRIEF SUMMARY OF THE INVENTION

It is accordingly an object of the present invention to provide a translucent block assembly which includes a novel and advantageous means for connecting translucent blocks into a frame recess having a width less than that of the blocks.

According to the present invention, there is provided a translucent block assembly which has a plurality of translucent blocks juxtaposed relative to one another in an opening defined by a frame, with an elongate connector extending around the opening between the frame and the translucent blocks for securing the translucent blocks in position in the opening. The frame defines a recess extending around the opening, and the translucent blocks have locating portions thereof spaced apart from one another at the peripheries of the blocks to form gaps. The connector includes a first portion abutting the translucent blocks and a second portion abutting the frame. The first portion comprises a longitudinally extending alignment projection which fits snugly into the gaps in the blocks for aligning the blocks, and the second portion includes faces spaced apart laterally of the connector by the width of the recess and engaging snugly in the recess for locating the connector relative to the frame.

With this arrangement, the first portion of the connector can be made as wide as may be required, depending on the width of the blocks, while the second portion can be made to fit into a standard recess width.

In the preferred embodiment of the invention, the connector is in the form of an extrusion, which is shaped, and which is formed with a thermal barrier, so as to counteract heat conduction through the connector.

BRIEF DESCRIPTION OF THE DRAWINGS

Further features, objects and advantages of the present invention will be more readily apparent to those skilled in the art from the following description of a preferred embodiment thereof illustrated, by way of example, in the accompanying drawings, in which.

DESCRIPTION OF THE PREFERRED EMBODIMENT

Figure 1:
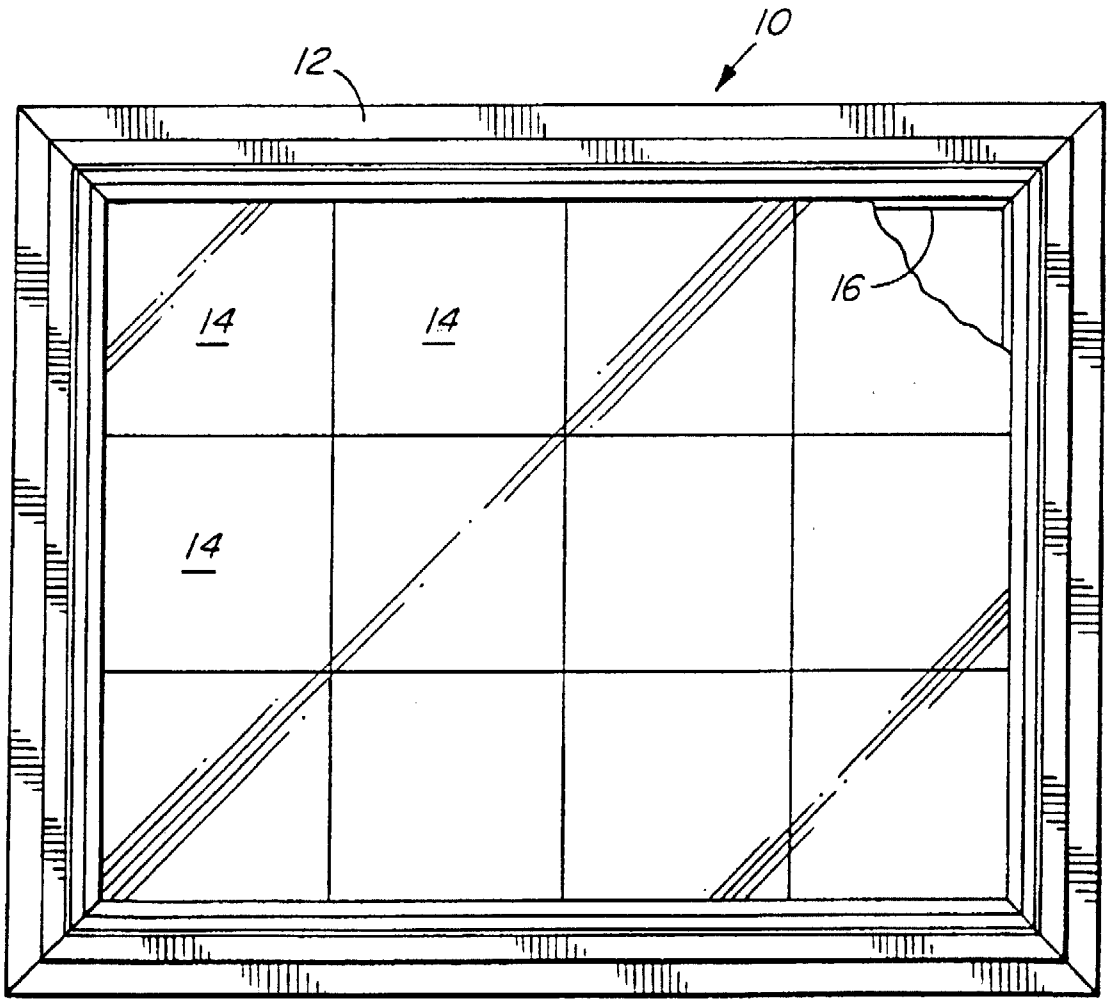
FIG. 1 shows a view in front elevation of a translucent block assembly embodying the present invention.

In FIG. 1 there is shown a translucent block assembly indicated generally by reference numeral 10, which is made up of a conventional rectangular window frame 12, a plurality of translucent blocks 14, which are juxtaposed relative to one another within an opening formed by the window frame 12, and an elongate connector in the form of an extrusion 16, which interposed between the blocks 14 and the window frame 12 and which serves, as described in greater detail below, to align and locate the blocks 14 relative to one another and, also, relative to the window frame 12.

Figure 2:
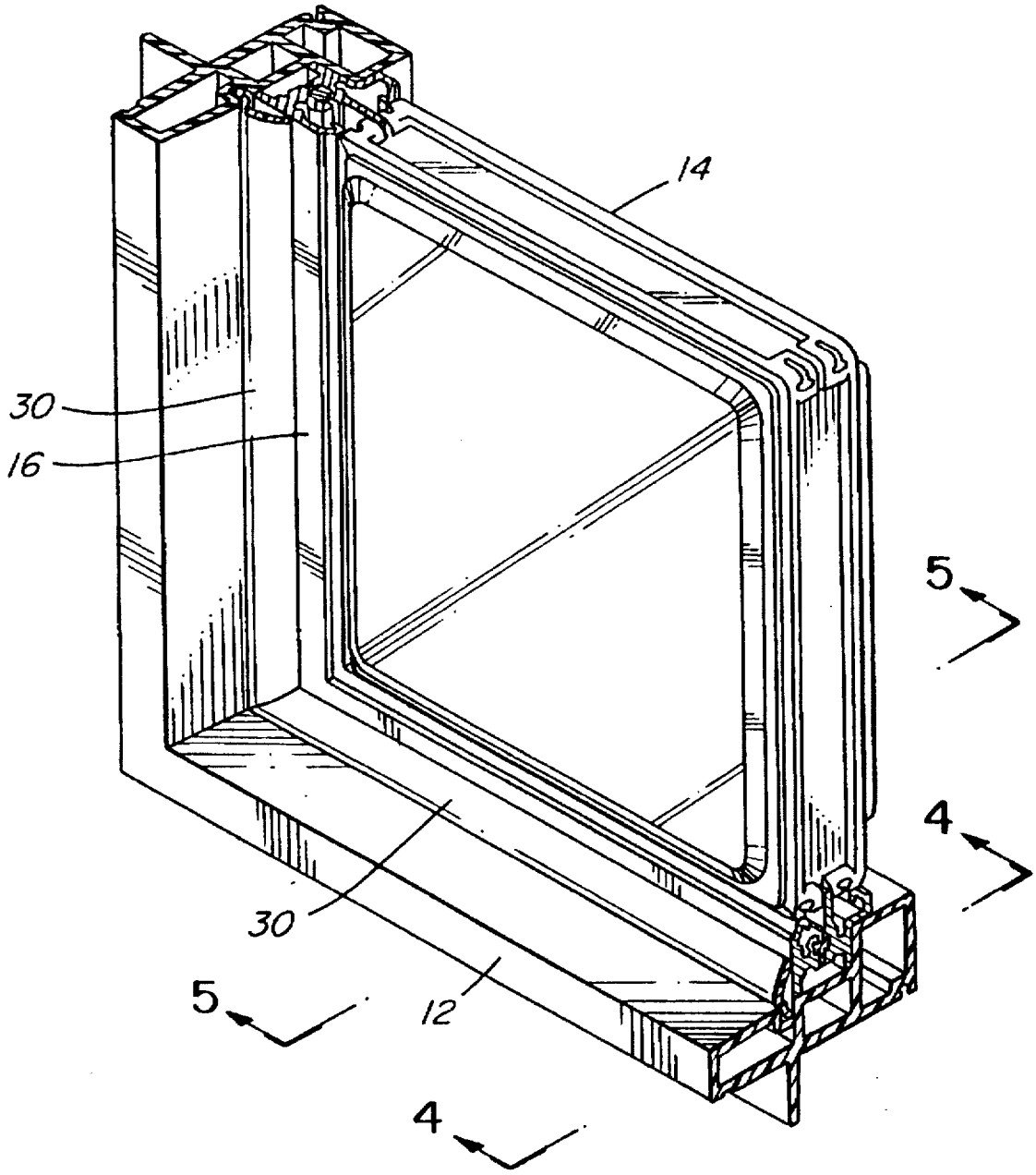
FIG. 2 shows a broken-away view, in perspective, of a part of the assembly of FIG. 1.

In FIG. 2, a single one of the blocks 14, which are formed in accordance with the teachings of the above-identified prior patent, is shown in position in a comer of the window frame 12.

Figure 3:
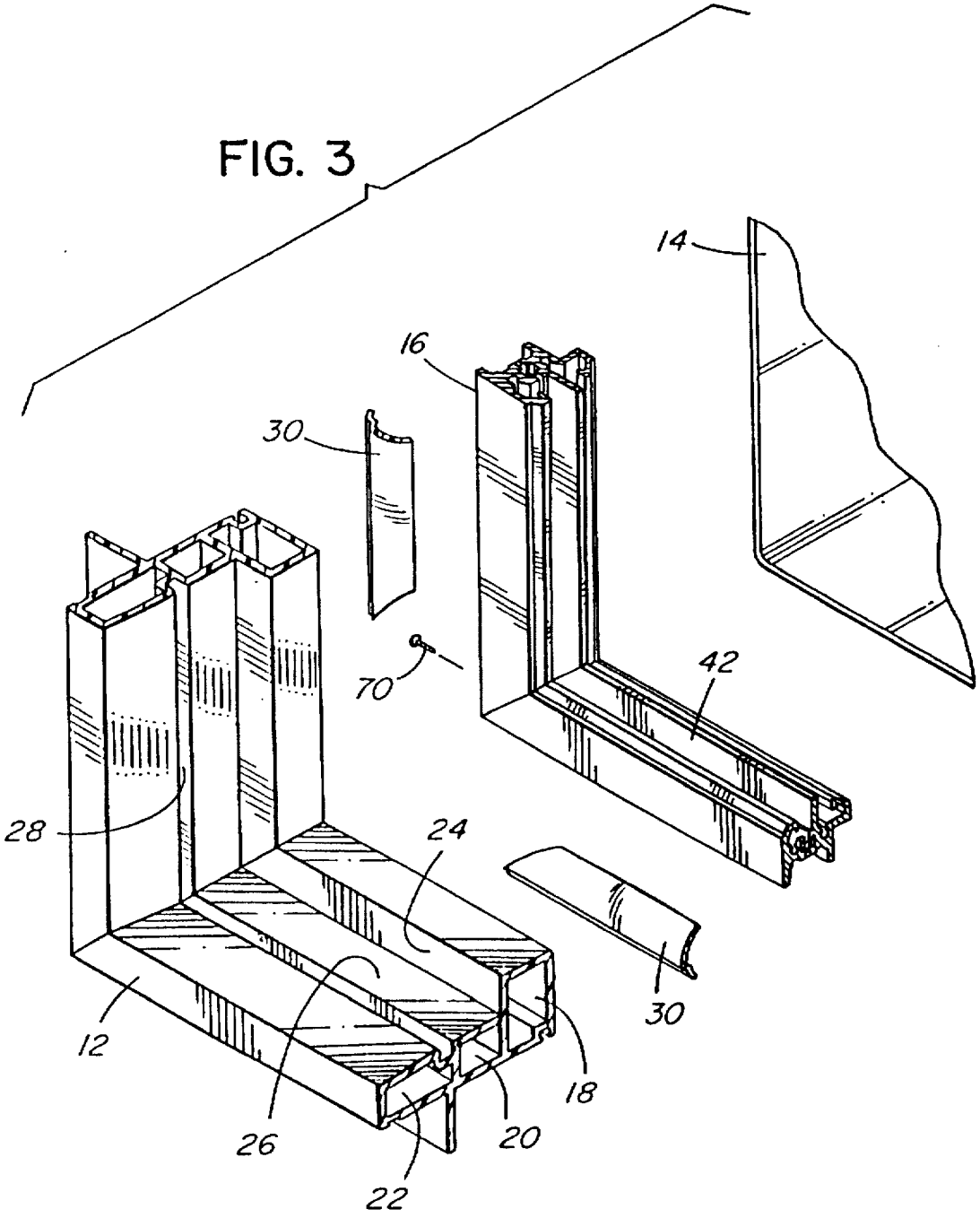
FIG. 3 shows an exploded, broken-away view of parts of the assembly of FIG. 1.
Figure 4:
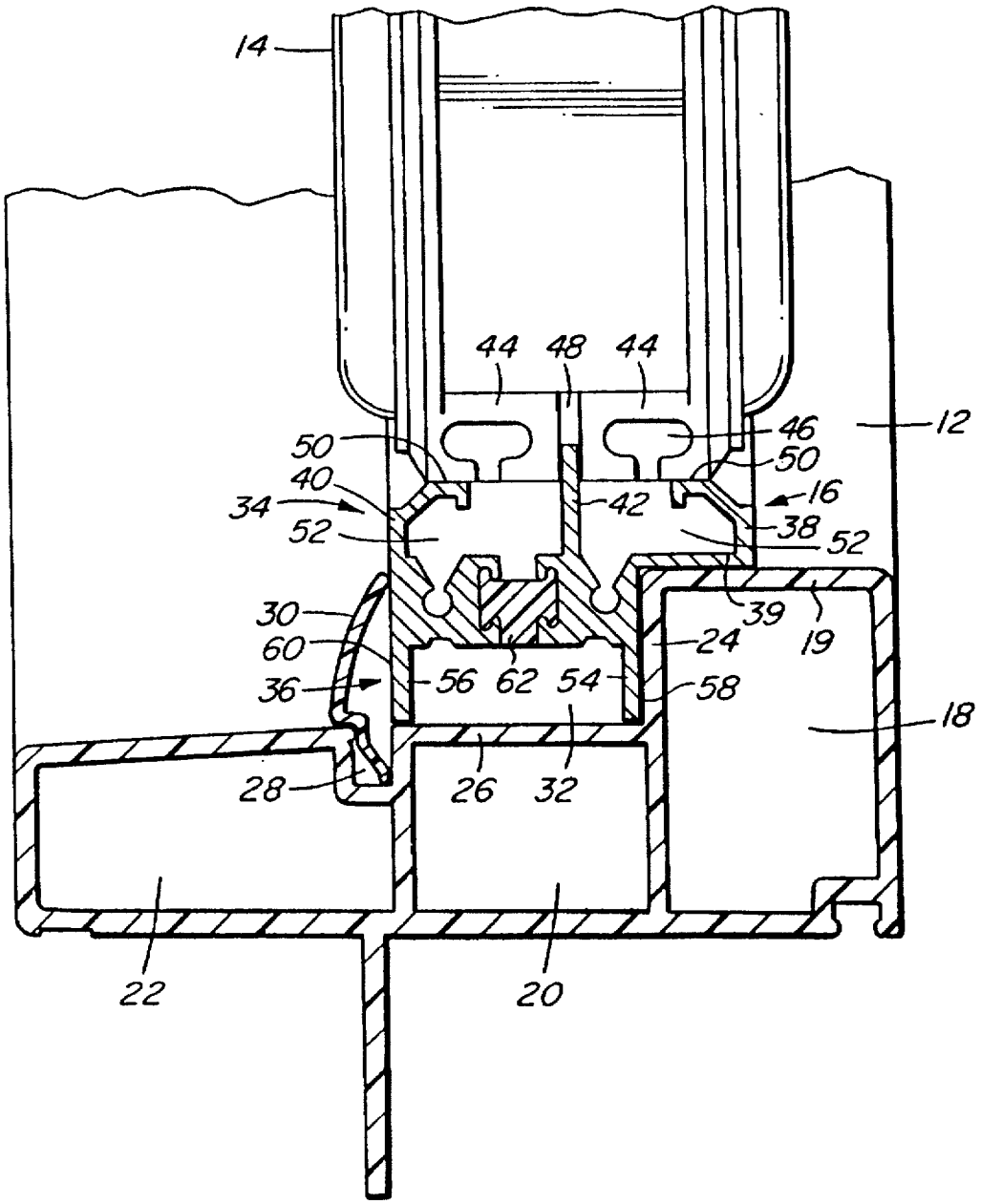
FIGS. 4 and 5 show broken-away views taken in cross-section along the lines 4—4 and 5—5, respectively, of FIG. 2.
Figure 5:
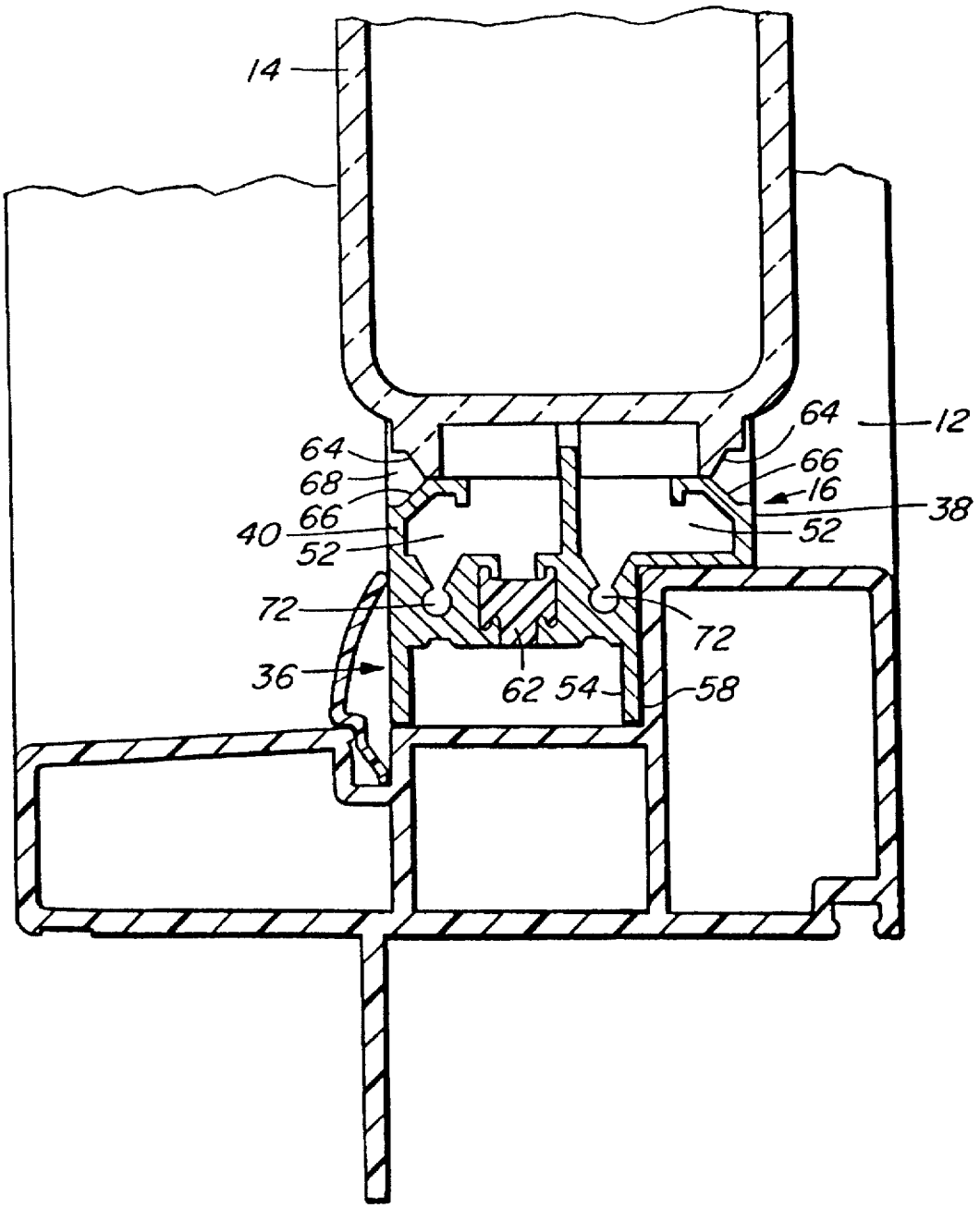

As can be seen in FIG. 2, the window frame 12 is formed as an extrusion, the shape of which is more clearly apparent from FIGS. 3, 4 and 5, and which is formed of three hollow portions 18, 20 and 22. The hollow portion 18 is at the innermost side of the window frame and the hollow portion 22 forms, at the bottom of the window flame, a window ledge. The hollow portion 18 is higher than the hollow portion 20 so as to form a step shaped recess 32, having a side wall 24 and a bottom wall 26. Between the hollow portions 20 and 22, there is formed a recess 28, which extends around the window opening and receives and retains a retainer strip 30 of plastic material. The retainer strip 30 has longitudinal edge thereof engaged in the recess 28 and, at its other longitudinal edge, abuts the extrusion 16 so as to fixedly secure the extrusion 16 and the blocks 14 relative to the window frame 16. The arrangement is such that the recess 32, is open inwardly of the window frame opening defined by the window frame 12 and also at lateral one side of the recess 32, which is the left-hand side of the recess 32 as viewed in FIGS. 4 and 5.

The connector 16 is in the form of an extrusion having a first portion generally by reference numeral 34 and a second portion indicated by general reference numeral 36. The first portion 34 comprises a pair of webs 38 and 40, at opposite sides of the connector 16, and an alignment projection in the form of a flat web 42.

The periphery of the block 14 is formed, at each corner of the block 14, with a pair of enlarged locating portions 44 which, in known manner, are formed with T-shaped recesses 46 for receiving connectors (not shown) for connecting the blocks to one another.

The locating portions 44 are spaced apart from one another to form a gap 48 therebetween, and the connector web 42 fits snugly into the gap 48 for aligning and locating the block 14 relative to the window frame 12 and, also, relative to the other blocks 14 of the assembly.

The webs 38 and 40, which extend from opposite sides of the second portion 36 of the connector extrusion 16, are spaced laterally from the web 42 and have abutment faces 50 in abutting engagement with the periphery of the block 14 at opposite lateral extremities of the periphery of the block 14. As is readily apparent from FIGS. 4 and 5, the periphery of the translucent block 14 has a width greater than that of the window frame recess 32. The web 38 includes a web portion 39 in face-to-face contact with a flat innermost wall 19 of the hollow portion 18.

The first portion 34 of the connector extrusion also has gaps 52 extending longitudinally of the connector extrusion between the web 42 and the webs 38 and 40, and also extending from the second portion 36 to the abutment faces 50, so as to prevent heat conduction between the webs 38 and 40 across the width of the connector 16.

The second portion 36 of the connector 16 has a pair of flat, parallel, laterally spaced webs 54 and 56, which have outer side faces 58 and 60 spaced, laterally of the connector 16, by the width of the window frame recess 32 and engaging snugly in the recess 32. The face 58 abuts the side wall 24 of the hollow portion 18. The edges of the webs 54 and 56 abut the bottom wall 26 of the recess 32.

The second portion 36 of the connector 16 also includes a portion 62 of low thermal conductivity which forms a thermal break between the opposite lateral sides of the connector 16.

The block 14 is formed with inclined outer edge faces 64 (FIG. 5), and the webs 38 and 40 are formed with inclined outer faces 66, the faces 64 and 66 converging with one another to form outwardly-open V-shaped recesses 68 where the translucent block 14 meets the webs 38 and 40. In this way, by painting the faces 66 a suitable colour, the assembly can be given the appearance of a grout between the connector 16 and the block 14.

The connector 16 is formed of four extrusion strips which are connected to one another, at the corners of the window frame opening, by fasteners in the form of screws 70 (FIG. 3) driven into circular recesses 72 (FIG. 5) in the second portion 34 of the connector 16.

As will be apparent to those skilled in the art, various modifications may be made in the above-described embodiment of the invention within the scope and spirit of the appended claims.

We claim:

1. A translucent block assembly, comprising:

a window frame defining an opening;

a plurality of translucent blocks juxtaposed in abutment with one another in the opening, each of said translucent blocks having mutually spaced locating portions forming a gap at the periphery thereof;

an elongate connector extending around said opening between said window frame and said translucent blocks;

said window frame having a step-shaped recess extending around the opening, and said step-shaped recess being open along one lateral side thereof and inwardly of said window frame to allow insertion of said translucent blocks and said elongate connector into the opening; and a retainer engaging said elongate connector and said frame and fixedly securing said elongate connector and said translucent blocks relative to said frame;

said elongate connector having a first portion thereof abutting the peripheries of said translucent blocks and a second portion thereof engaged in said step-shaped recess, and said first portion of said elongate connector including a longitudinally extending alignment projection which fits snugly into said gaps in said translucent blocks for aligning and retaining said blocks.

2. A translucent block assembly as claimed in claim 1, wherein said translucent blocks and said first portion of said connector have widths, in a direction extending transversely to said translucent blocks and said elongate connector, which are greater than that of said step-shaped recess.

3. A translucent block assembly as claimed in claim 1, wherein said elongate connector includes a portion of low thermal conductivity forming a thermal break between opposite lateral sides of said elongate connector.

4. A translucent block assembly as claimed in claim 1, wherein said window frame defines a recess extending around said opening and said retainer comprises a retainer strip engaged in said recess and abutting said elongate connector.

5. A translucent block assembly as claimed in claim 1, wherein said first portion of said connector has, extending along opposite longitudinal sides thereof, surfaces which are inclined towards one another and inwardly relative to said opening, said surfaces extending to the peripheries of said translucent blocks and being colored to give the appearance of grout.

6. A translucent block assembly as claimed in claim 1, wherein said first portion of said elongate connector has a pair of abutments which are spaced apart, laterally of said elongate connector, at opposite sides of said alignment projection and which abut the peripheries of said translucent blocks.

7. A translucent block assembly as claimed in claim 6, wherein said abutments comprise a pair of webs extending longitudinally of said elongate connector from said opposite sides of said first portion and abutting said translucent blocks at opposite lateral extremities of the peripheries of said translucent blocks.

8. A translucent block assembly as claimed in claim 7, wherein said first portion of said elongate connector has gaps each extending longitudinally of said elongate connector between said alignment projection and said webs, and from said second portion to said abutments, to counteract heat conduction between said webs.

9. A translucent block assembly as claimed in claim 8, wherein said second portion of said connector includes a portion of low thermal conductivity forming a thermal break between opposite longitudinal sides of said second portion.

10. A translucent block assembly as claimed in claim 7, wherein said translucent blocks and said webs have inclined outer faces which converge to one another to form an outwardly open V-shaped recess where said translucent blocks meet said webs and said outer faces are colored to give the appearance of grout.

* * * * *